US008429943B2

(12) United States Patent
Jepsen et al.

(10) Patent No.: US 8,429,943 B2
(45) Date of Patent: Apr. 30, 2013

(54) PROCESS AND DEVICE FOR INTENTIONALLY INFLUENCING THE GEOMETRY OF ROUGHED-DOWN STRIPS IN A ROUGHING-DOWN STAND

(75) Inventors: Olaf Norman Jepsen, Siegen (DE); Heinz-Adolf Müller, Wilnsdorf (DE); Joachim Immekus, Olpe (DE)

(73) Assignee: SMS Siemag Aktiengesellschaft, Düsseldorf (DE)

( * ) Notice: Subject to any disclaimer, the term of this patent is extended or adjusted under 35 U.S.C. 154(b) by 1229 days.

(21) Appl. No.: 11/920,212

(22) PCT Filed: May 10, 2006

(86) PCT No.: PCT/EP2006/004392

§ 371 (c)(1),
(2), (4) Date: Jan. 14, 2008

(87) PCT Pub. No.: WO2006/119984

PCT Pub. Date: Nov. 16, 2006

(65) Prior Publication Data

US 2009/0044587 A1 Feb. 19, 2009

(30) Foreign Application Priority Data

May 11, 2005 (DE) ..... 10 2005 021 769

(51) Int. Cl.
*B21B 37/16* (2006.01)
*B21B 39/16* (2006.01)

(52) U.S. Cl.
USPC ..... 72/10.4; 72/250

(58) Field of Classification Search ..... 72/8.9, 72/9.1, 9.2, 10.4, 11.6–11.8, 15.5, 16.8, 16.9, 72/18.6–18.8, 19.6, 235, 250
See application file for complete search history.

(56) References Cited

U.S. PATENT DOCUMENTS 3,425,249 A * 2/1969 O'Brien ..... 72/11.2
4,570,472 A 2/1986 Kuwano et al.
5,634,360 A * 6/1997 Tazoe et al. ..... 72/12.5

FOREIGN PATENT DOCUMENTS

DE 31 16 278 11/1982

(Continued)

OTHER PUBLICATIONS

Patent Abstracts of Japan, BD. 012, No. 182 (M-702), May 27, 1988 & JP 62 292210 A (Sumitomo Metal Ind Ltd), Dec. 18, 1987.
Patent Abstracts of Japan, BD. 008, No. 227 (M-332), Oct. 18, 1984 & JP 59 110408 A (Sumitomo Kinzoku Kogyo KK), Jun. 26, 1984.

*Primary Examiner* — Debra Sullivan
(74) *Attorney, Agent, or Firm* — Lucas & Mercanti, LLP; Klaus P. Stoffel

(57) ABSTRACT

When rolling hot-rolled strips, different draughts per pass might occur during the rolling operation over the length of the roll gap, due to changes in the hardness of the rolling stock, to the roll gap itself or to the geometry of the incoming rolling stock. These different draughts per pass lead to lateral deviations and shifts of the rolling stock in the roll stand and to a lateral bending of the outgoing hot-rolled strip. In order to avoid these defects by intentionally influencing the geometry of the rough-rolled strip, it is proposed to interconnect in at least one roughing-down stand a dynamic positioning in the roughing-down stock (1) with fast and powerful lateral guides (8,9) arranged before and after the roughing-down stand (1), by corresponding regulation operations, in such a way that a grainy or tapering bloom (4) is shaped into a straight and taper-free roughed-down strip (5) in one or more passes, in continuous or reciprocating operation.

10 Claims, 5 Drawing Sheets

FOREIGN PATENT DOCUMENTS

| | | |
|---|---|---|
| DE | 42 10 547 | 6/1993 |
| DE | 43 10 547 | 3/1994 |
| DE | 197 04 337 | 8/1998 |
| EP | 0 925 854 | 6/1999 |

* cited by examiner

PROCESS AND DEVICE FOR INTENTIONALLY INFLUENCING THE GEOMETRY OF ROUGHED-DOWN STRIPS IN A ROUGHING-DOWN STAND

BACKGROUND OF THE INVENTION

The invention concerns a process and a device for hot rolling in a hot strip mill or in Steckel mills, where slabs are rolled out to near-net strip in one or more roughing stands.

The near-net strip produced in this way should be straight, i.e., it should have only slight strip cambering and should have no wedging over the width of the strip. It is the task of the roughing stands not merely to maintain the geometry of the near-net strip but rather to improve it in a systematic way, since the slabs entering the stands may already be affected by wedging or cambering. A change in the geometry of the near-net strip is possible primarily in the first passes, since the slab thickness is still large relative to the width, so that transverse flow of material in the roll gap is possible.

The rolling of hot strip is sometimes attended by variably large drafts per pass over the length of the roll gap (over the width of the strip), which can be attributed to variations in the quality of the rolling stock, to variations in the roll gap itself, or to the geometry of the entering rolling stock. These variably large drafts per pass then lead to lateral deflections and shifts of the rolling stock in the stand and to lateral curvature of the exiting hot rolled strip.

Various processes and devices are known for automatically controlling the advancement of the strip and for correcting the curvature of the exiting hot rolled strip.

For example, DE 197 04 337 A1 proposes a process for automatically controlling the advancement of rolled strip as it passes through a rolling train, where the position of the rolled strip relative to the center line of the rolling train is measured in at least one rolling stand, and the measured values are used for automatically adjusting the rolling force distribution in the longitudinal direction of the rolls of this rolling stand to obtain a desired set position. This measure results in advancement of the rolled strip that is very nearly symmetrical to the center line, but it may also lead to the development of wedging of the rolled strip.

DE 43 10 547 C2 discloses another possible process for preventing lateral bending of the rolled strip, which is moved continuously through a roughing train with an edging mill for influencing the width of the strip and a horizontal rolling mill for influencing the thickness of the strip, in which hydraulically adjustable lateral guides are installed along the sides of the rolled strip. The lateral guides are arranged upstream and downstream of the edging mill and control the lateral shifting of the rolled slab, and they allow unhindered entrance and exit of the rolled strip by alternate narrowing of the distance between the lateral guides.

DE 31 16 278 C2 discloses a device for controlling the position of the strip travel, especially during finish rolling, in which guide strips arranged alongside the rolled strip have bending bars with guide rollers, which are pressed laterally against the rolled strip. The automatic position control system of these rollers has a superimposed automatic pressure control system, which, when disturbing forces arise that exceed a preset value, brings about a shift of the guide strips or guide rollers in the opening direction.

SUMMARY OF THE INVENTION

With this prior art as a point of departure, the objective of the invention is to effect systematic influencing of the geometry of the near-net strip during hot rolling in conventional hot strip mills or in Steckel mills, with the goal of producing straight near-net strips without wedging and without lateral curvature.

The objective of the invention with respect to a process is achieved such that, in at least one roughing stand, to effect systematic influencing of the geometry of the near-net strip, dynamic adjustment in the roughing stand is combined with fast and powerful lateral guides upstream and downstream of the roughing stand by means of suitable automatic controls in such a way that a slab affected with cambering or wedging is systematically shaped into a straight and wedge-free near-net strip in one or more passes in a reversing or continuous operation. Advantageous modifications are specified in the dependent claims.

In accordance with the invention, the geometry of the near-net strip is influenced by adjustment in the horizontal stand and in the two adjustable lateral guides upstream and downstream of the stand. The adjustment in the horizontal stand provides for constant strip thickness over the width of the strip (no wedging). To this end, the RAC (roll alignment control), which has not previously been used for roughing stands, is used to control the adjustment in such a way that the roll gap remains parallel even in the case of disturbances originating with the strip. Disturbance variables include above all a thickness wedge over the width of the strip on the run-in side, temperature differences over the width of the strip, eccentric position of the strip in the roll gap, and non-uniform distribution of tensile forces over the width of the strip on the run-in side as well as the runout side.

In accordance with the principle of roll alignment control, the differential force is measured, and a roll alignment value is computed by the roll alignment control system. Half of this value is then used as an additional set value for the separate automatic position control of the drive side and service side of the stand. One then proceeds accordingly for the adjustments of the contact pressures by the hydraulic cylinders. In principle, the control system compensates the stand transverse strain that arises due to the differential forces.

The purpose of the lateral guides is to prevent curvature or twisting of the strip (cambering). To this end, the lateral guides are kept parallel on each side and the same distance from the center of the stand. The synchronism of the opposite guide plates of a lateral guide is mechanically realized, and the adjustment is carried out with an electric or hydraulic drive. Hydraulically driven lateral guides are best suited for the process of the invention described here, since hydraulic drives are very dynamic and make it possible, without great expense, to achieve not only automatic position control but also automatic force control to keep the strip straight. The automatic position control keeps the lateral guides at a separation that is somewhat greater than the strip width, for example, the strip width plus 10 mm on the run-in side and the strip width plus 40 mm on the runout side.

An automatic force control system, which protects the lateral guides from overload and presses the lateral guide against the strip with a well-defined force, is superimposed on this automatic position control system. Position monitoring increases the force set value when the lateral guides are trying to deviate.

As a result of the cooperation of these adjustment systems and control systems in accordance with the invention, it is possible to shape a slab affected with cambering or wedging into a straight and wedge-free near-net strip. If, for example, a straight slab with wedging in the thickness profile enters the roughing stand, a near-net strip that exits wedge-free is produced by the roll gap, which is forced to be kept parallel. As a result of this forced profile change, the strip exits cambered in one direction, and the strip on the run-in side tries to turn in this direction. The lateral guides prevent these movements, and reactive forces arise which act against the lateral guides. At the same time, tensile forces arise in the strip over the width of the strip, which act on the roll gap and produce material flow in the roll gap transversely to the rolling direction. This transverse flow of material, which can occur only in the case of suitably thick rolling stock, is thus the phenomenon that basically allows the geometry of the near-net strip to be influenced in accordance with the invention.

To prevent overloading of the adjustment systems in the case of extreme geometric defects and to make it possible to distribute the geometric change over several passes, in accordance with the invention, the automatic control of the adjustment of the rolls can additionally be coupled with the automatic control of the lateral guides. This coupling is achieved by the following procedure:

- presetting of a reference value of the differential rolling force or of a maximum roll alignment value as a function of the current compressive forces or the current positions of the lateral guides or
- presetting of the position set values or of the force set values of the lateral guides as a function of the current differential rolling force or of the differential position of the roll alignment.

Further details and advantages of the invention are explained in greater detail below with reference to the specific embodiments illustrated in the schematic drawings.

DETAILED DESCRIPTION OF THE INVENTION

Figure 1:
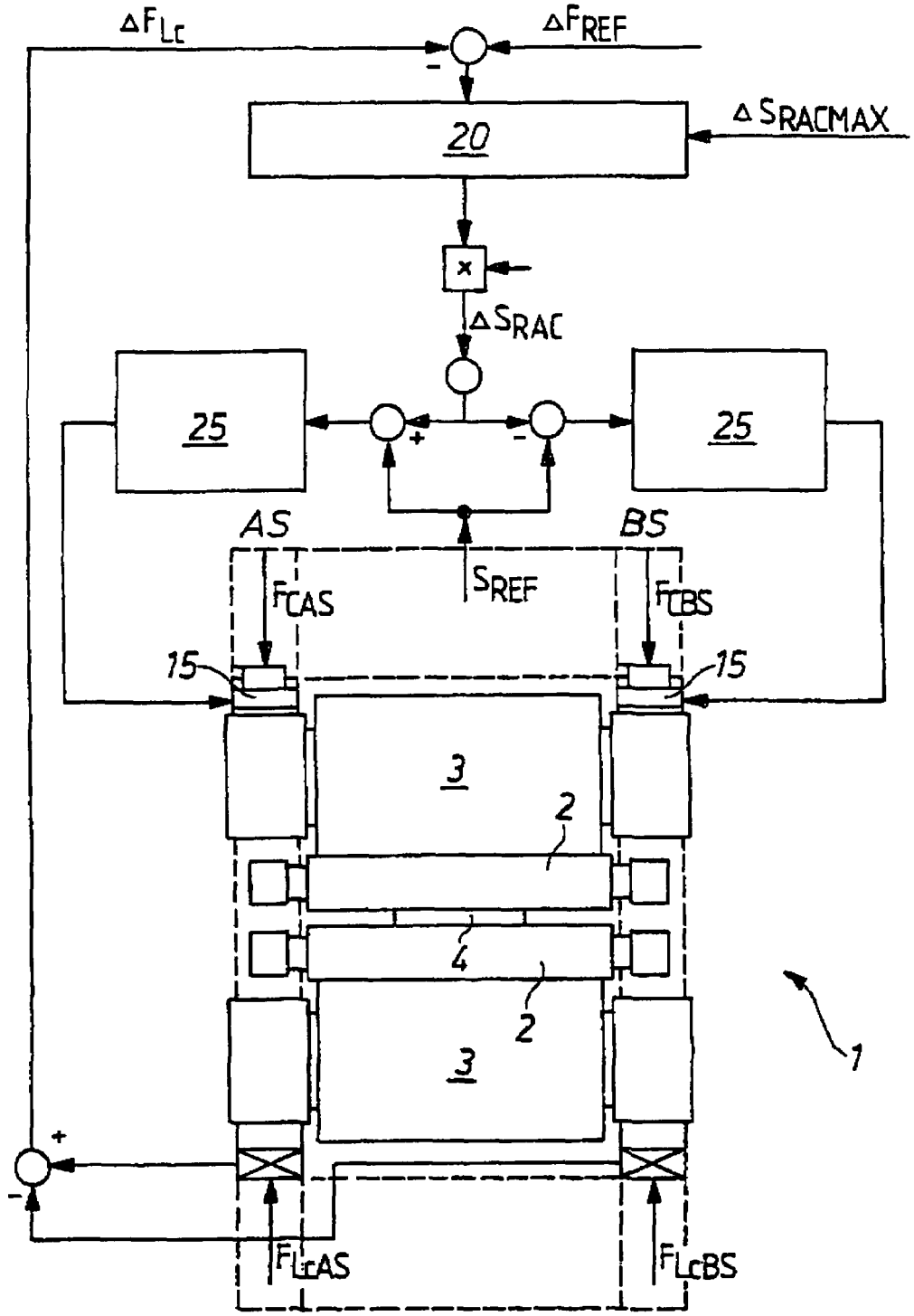
FIG. 1 shows an control diagram of the roll adjustment (roll alignment control (RAC)).

FIG. 1 shows the part of the control system combination of the invention that relates to the roll adjustment for the horizontal rolls of the roughing stand, specifically, the control diagram of a roll alignment control (RAC) system. In the roughing stand 1, which is shown in a front elevation with work rolls 2, backup rolls 3, and slab 4, cylinder forces $F_{CAS}$, $F_{CBS}$ are applied on the drive side (AS) and on the service side (BS) by means of hydraulic cylinders 15 mounted on the bearing of the upper backup roll 3, and the forces resulting during the rolling operation on the lower bearing surface of the backup rolls are continuously measured. The differential rolling force $\Delta F_{LC}$ is determined from the measured force values $F_{LcAS}$ and $F_{LcBS}$ thus obtained and, together with a reference value $\Delta F_{REF}$ of the differential rolling force, is supplied to the roll alignment control RAC 20, where a reference roll alignment value $\Delta S_{RAC}$ is computed. This roll alignment value $\Delta S_{RAC}$ is then halved and used as an additional set value together with the reference position $S_{REF}$ for the separate automatic position controls 25 of the drive side (AS) and the service side (BS) of the upper backup roll 3, where the adjustment then acts laterally on the hydraulic cylinders 15.

Figure 2:
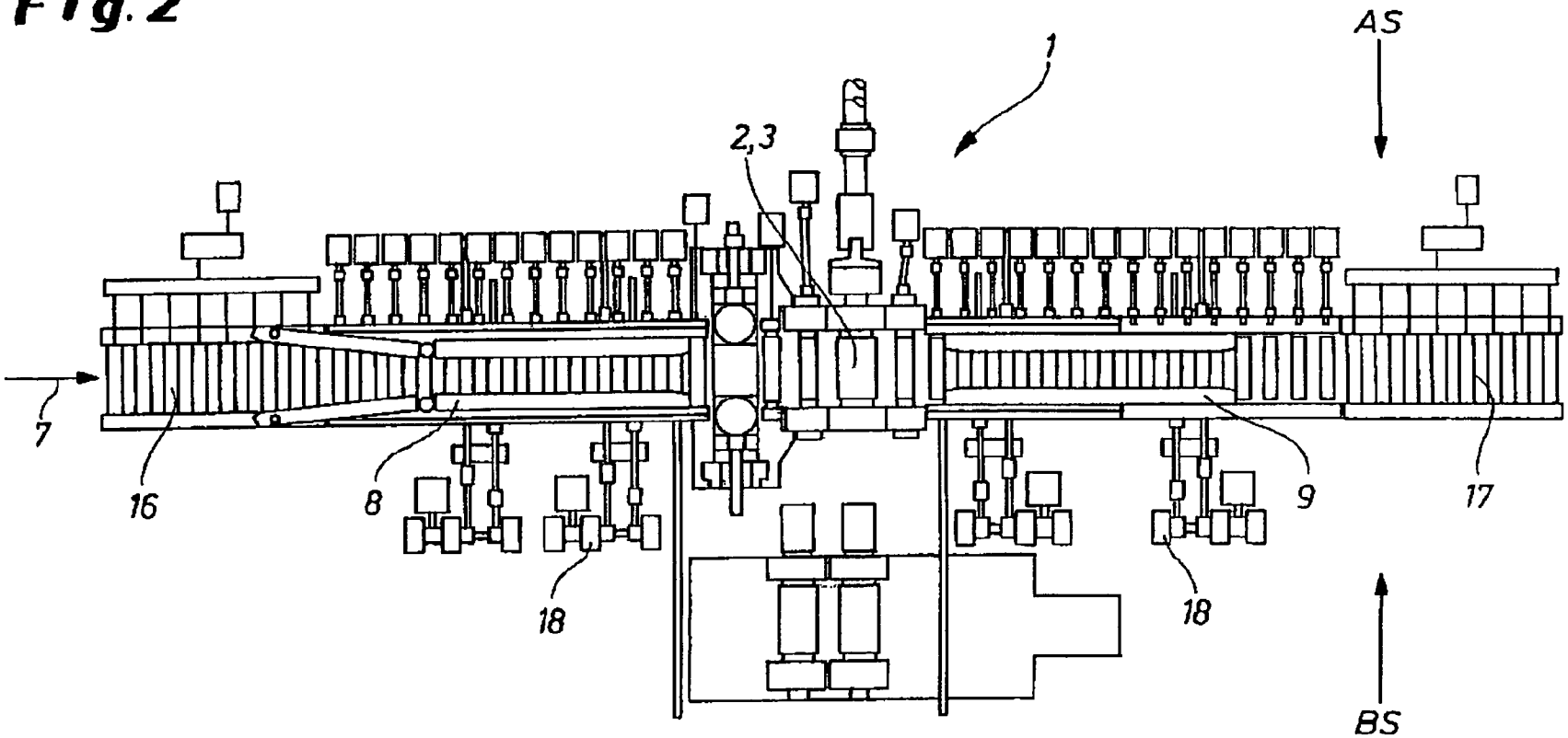
FIG. 2 shows a top view of a roughing stand.
Figure 3:
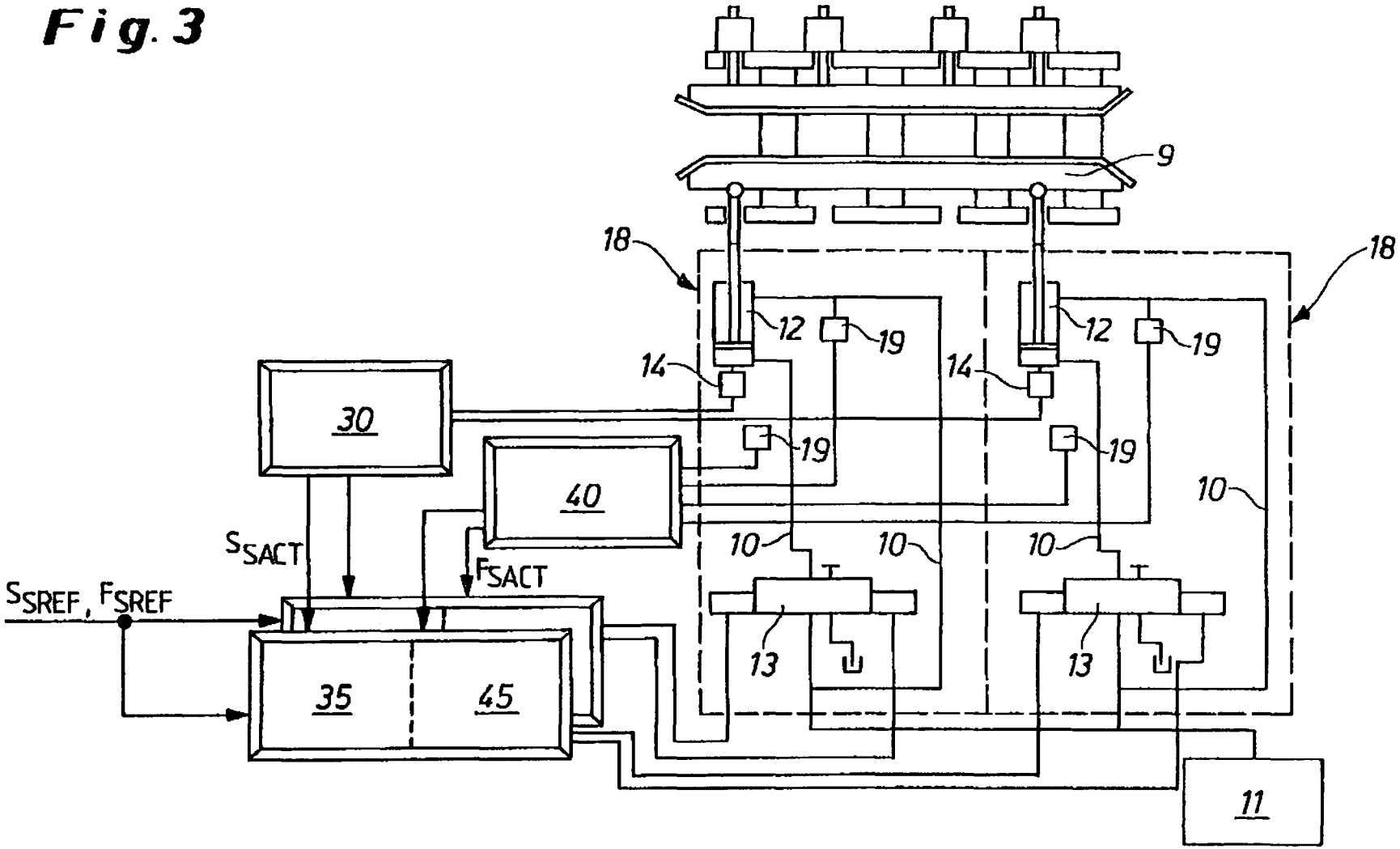
FIG. 3 shows a control diagram of the lateral guides.

FIGS. 2 and 3 show the other part of the control system combination of the invention, namely, the automatic control of the lateral guides 8, 9, which are arranged laterally alongside the rolled strip as part of the roughing stand 1. FIG. 2 shows a top view of a roughing stand with backup rolls 3 and work rolls 2. Lateral guides 8 are installed opposite each other on the run-in roller table 16 upstream (with respect to rolling direction 7) of the rolls 2, 3 with hydraulically driven adjustment devices 18 arranged on the drive side AS of the roughing stand 1. As the circuitry in FIG. 3 shows, these adjustment devices 18 consist of a common hydraulic unit 11 (hydraulic pump), piston-cylinder units 12, control valves 13, and various hydraulic lines 10. Furthermore, measuring instruments are present for determining the piston position 14 and the hydraulic pressure 19. To facilitate the run-in and the centering of the slab in the center of the stand, the distance between the lateral guides 8 is conically increased at their front end.

In the same way, lateral guides 9 are installed opposite each other on the runout roller table 17 downstream of the rolls 2, 3. The distance separating the lateral guides 9 has been adjusted to the now changed strip width (this change in strip width is not shown in the drawing). The control diagram used in accordance with the invention is explained with reference to FIG. 3 for the lateral guide 9 shown in FIG. 2. The current piston positions determined by the measuring instruments 14 are fed to a position computer 30, and the current compressive forces determined by the measuring instruments 19 are fed to a force computer 40. The current values obtained there for the positions $S_{SACT}$ are fed to the position control unit 35, and the current values for the compressive forces $F_{SACT}$ are fed to the force control unit 45. The preassigned reference values for the positions $S_{SREF}$ and for the hydraulic pressures $F_{SREF}$ are used to determine the positions and forces that are to be automatically set, and these positions and forces are transmitted to the piston-cylinder units 12 via the control valves 13.

Figure 4:
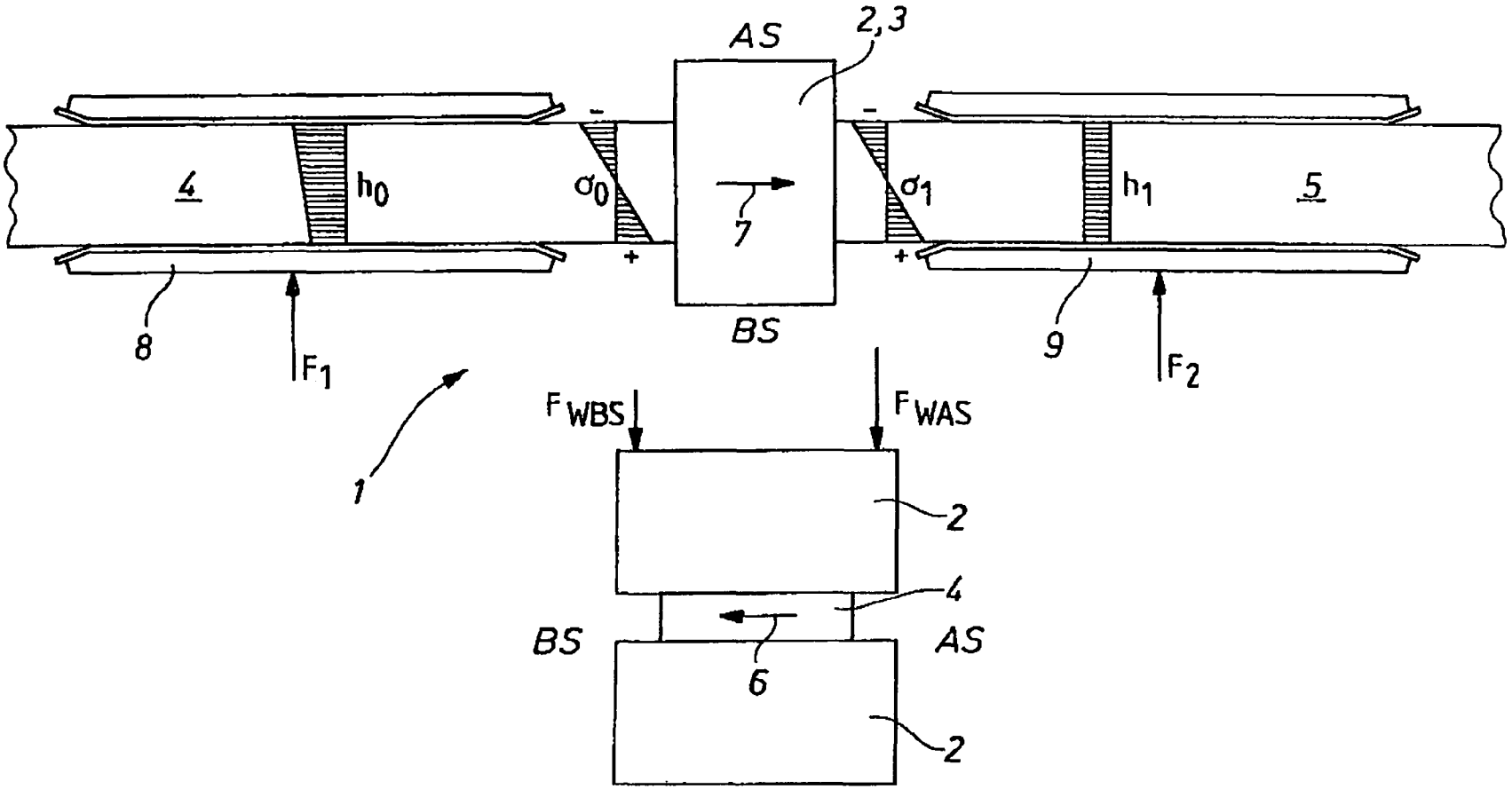
FIG. 4 shows the combination of the control diagrams of FIGS. 1 and 3.

The effect of the two simultaneously performed automatic controls of the invention are shown schematically in FIG. 4. The slab 4, which enters the rolling stand in rolling direction 7 (the rolling stand is symbolized only by the work roll 2), contains a tapered thickness profile (denoted $h_0$) over the width of the slab, with the thickness increasing towards the drive side (AS). The rolling operation eliminated the tapered thickness profile and produced a near-net strip with the thickness profile $h_1$. During the rolling operation, the rolling force $F_{WAS}$ to be applied by the work rolls 2 on the drive side (AS) was greater than the rolling force $F_{WBS}$ to be applied on the service side (BS), so that a transverse flow of material occurred from the drive side to the service side in arrow direction 6.

To prevent lateral twisting of the entering slab 4 and cambering of the near-net strip 5 during the elimination of the tapered thickness profile, the entering slab 4 is laterally supported by the lateral guides 8, and the exiting near-net strip 5 is laterally supported by the lateral guides 9.

The supporting forces $F_1$ and $F_2$ upstream and downstream of the rolling stand produce as a reaction the tension profile $\sigma_0$ in the entering slab 4 and the tension profile $\sigma_1$ in the exiting near-net strip 5. These tension profiles $\sigma_0$, $\sigma_1$ act on the roll gap and allow the transverse flow of material 6, which in turn makes it possible to correct the geometric defect of the slab.

Figure 5:
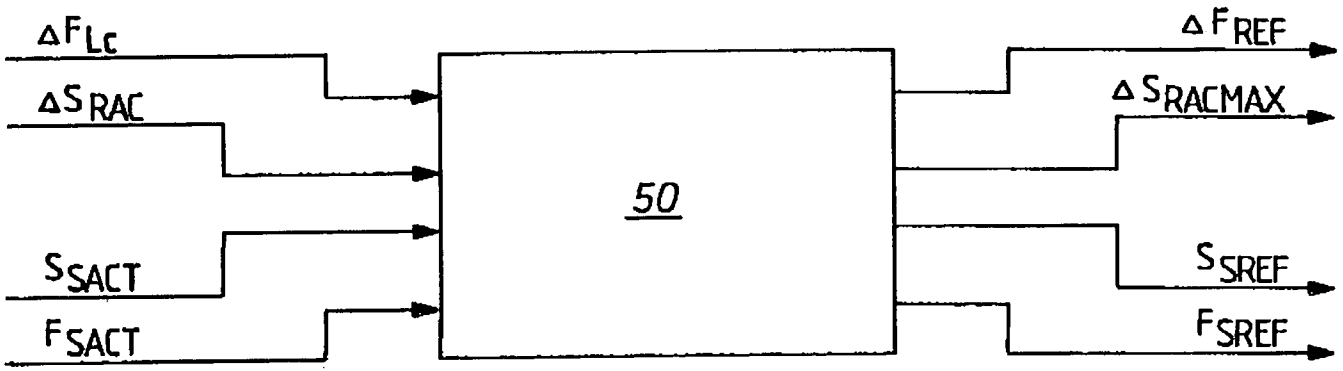
FIG. 5 shows the coupling of roll adjustment and lateral guides.

FIG. 5 is a schematic representation of the above-described possibilities of the coupling, in accordance with the invention, of the adjustment of the rolls and the lateral guides with the goal of limiting the load of the adjustment system and of distributing the correction of the slab geometry over several passes.

The drawing shows a coupling control unit 50. The current values of a rolling stand for the differential rolling force $\Delta F_{LC}$ the differential position of the differential roll alignment value $\Delta S_{RAC}$ the positions of the lateral guides $S_{SACT}$ the compressive forces of the lateral guides $F_{SACT}$ flow into the coupling control unit 50, as indicated by corresponding directional arrows, and set points are taken from the coupling control unit 50 for use in the downstream rolling stand, again, as indicated by corresponding directional arrows:

a reference value of the differential rolling force $\Delta F_{REF}$ a maximum roll alignment value $\Delta S_{RACMAX}$ the position reference values of the lateral guides $S_{SREF}$ the force reference values of the lateral guides $F_{SREF}$.

The invention is not limited to the illustrated embodiments but rather can be varied, for example, according to the design of the roughing stand that is used or according to the design of the lateral guide drives that are used, as long as the given embodiment is still based on the measure of the invention of combining roll alignment control (RAC) of the rolls with mechanical adjustment of the lateral guides for the rolling stock.

LIST OF REFERENCE SYMBOLS

AS roll drive side
BS roll service side
1 roughing stand
2 work roll
3 backup roll
4 slab
5 near-net strip
7 rolling direction
8 lateral guide, run-in side
9 lateral guide, runout side
10 hydraulic lines
11 hydraulic unit
12 piston-cylinder unit for lateral guides
13 control valve
14 measuring instrument for piston position
15 hydraulic cylinder for roll alignment control
16 run-in roller table
17 runout roller table
18 adjustment device for lateral guides
19 measuring instrument for hydraulic pressure
20 roll alignment control (RAC)
25 automatic position control for roll alignment control
30 position computer for lateral guides
35 automatic position control for lateral guides
40 force computer for lateral guides
45 automatic force control for lateral guides
50 coupling control unit Rolled Strip Characteristics

6 direction of transverse flow
$h_0$ thickness profile on the run-in side
$h_1$ thickness profile on the runout side
$\sigma_0$ tension profile on the run-in side
$\sigma_1$ tension profile on the runout side Positions $S_{REF}$ reference position
$S_{SREF}$ position reference values
$S_{SACT}$ current positions of the lateral guides
$\Delta S_{RAC}$ reference roll alignment value
$\Delta S_{RACMAX}$ maximum roll alignment value Forces $F_{LcAS}$ measured force, drive side
$F_{LcBS}$ measured force, service side
$F_{CAS}$ cylinder force, drive side
$F_{CBS}$ cylinder force, service side
$\Delta F_{LC}$ differential rolling force
$\Delta F_{REF}$ reference value of the differential rolling force
$F_{SREF}$ force reference value of the lateral guides
$F_{SACT}$ current compressive forces of the lateral guides
$F_{WAS}$ rolling forces on the drive side
$F_{WBS}$ rolling forces on the service side
$F_1$, $F_2$ forces on the lateral guides

The invention claimed is:

1. A process for hot rolling slabs in a hot strip mill or in Steckel mills, comprising the steps of:

applying lateral contact pressure against the slabs via lateral guides upon occurrence of skewed running of the slabs, the lateral guides extending in a rolling direction of the slabs;

systematically influencing geometry of a near-net strip during rolling of the slabs into the near-net strip in at least one roughing stand by carrying out in combination 1) a roll alignment for dynamic adjustment in a horizontal stand that is based on a continuously measured differential rolling force ($\Delta F_{LC}$), and 2) a fast and powerful position and force control of the lateral guides which are installed upstream and downstream of the roughing stand, where piston position and piston pressure of piston-cylinder units that adjust the lateral guides are used for controlling the lateral guides, and adjusting a distance between the lateral guides so that the distance conically increases at front ends of the guides, so that a slab affected with cambering or wedging is systematically shaped into a straight and wedge-free near-net strip in at least one pass in a reversing or continuous operation.

2. A process in accordance with claim 1, including carrying out the dynamic adjustment by roll alignment control (RAC) (20), where a reference roll alignment value ($\Delta S_{RAC}$) is computed from the measured differential rolling force ($\Delta F_{LC}$) and a reference value of a differential rolling force ($S_{REF}$), taking into account a maximum roll alignment value ($\Delta S_{RACMAX}$), and half of the computed value is used as an additional set value for separate automatic position controls (25) of a drive side (AS) and a service side (BS) of the roughing stand (1).

3. A process in accordance with claim 1, including maintaining the lateral guides (8, 9) installed upstream and downstream of the roughing stand (1) parallel on each side and at a uniform distance from a center of the stand by the piston-cylinder units (12), including using automatic position control (35) and automatic force control (45).

4. A process in accordance with claim 3, including carrying out the automatic position control (35) of the lateral guides (8, 9) so that a lateral distance separating each set of lateral guides (8, 9) differs and in each case is somewhat greater than a width of the strip .

5. A process in accordance with claim 3, including pressing the lateral guides (8, 9) against the slab (4) or the near-net strip (5) with a well-defined force ($F_1$, $F_2$) by the automatic force control (45) and thus are protected against an overload.

6. A process in accordance with claim 5, wherein upon occurrence of possible deviation of the lateral guides (8, 9), a force set value ($F_{SACT}$) of the automatic force control (45) is increased accordingly by position monitoring.

7. A process in accordance with claim 1, including coupling the roll alignment control and the position and force controls of the lateral guides (8, 9) with one another in such a way that, upon occurrence of extreme geometric defects of the slab entering the roughing stand (1), a desired geometric change can be carried out over several passes.

8. A process in accordance with claim 1, wherein for distributing a correction of slab geometry over several passes, current values of a rolling stand are determined for a differential rolling force $\Delta F_{LC}$ a differential position of the differential roll alignment value $S_{SACT}$ positions of the lateral guides $S_{SACT}$, and compressive forces of the lateral guides $F_{SACT}$ flow into a coupling control unit (50), from which set points are then taken for use in the downstream rolling stand a reference value of the differential rolling force $\Delta F_{REF}$ a maximum roll alignment value $\Delta S_{RACMAX}$ position reference values of the lateral guides $S_{SREF}$, and force reference values of the lateral guides $F_{SREF}$.

9. A device for hot rolling slabs in a conventional hot strip mill or in Steckel mills, where at least one rolling stand is designed with swiveling rolls and has a device on a slab run-in side with which lateral contact pressure can be applied against the slabs, wherein to carry out the hot rolling of the slabs (4)to near-net strip (5), the at least one rolling stand is a roughing stand (1)

designed with roll alignment control (20) based on a continuously measured differential rolling force ($\Delta F_{LC}$), and, wherein the lateral contact pressure device includes lateral guides (8, 9) that extend in a rolling direction of the slabs, which have fast and powerful automatic position control (35) and force control (45) and can be hydraulically adjusted by piston-cylinder units (12), are installed on the rolling stock run-in side and on a rolling stock runout side of the roughing stand (1), where the roll alignment control (20) of the roughing stand (1) and the automatic position control (35) and automatic force control (45) of the lateral guides (8, 9) are coupled with one another in such a way with respect to their measurement and automatic control engineering that a slab (4) affected with cambering or wedging is systematically shaped into a straight and wedge-free near-net strip (5) in one or more passes in a reversing or continuous operation, a distance between the lateral guides conically increases at front ends of the lateral guides.

10. A device in accordance with claim 9, wherein the distance between the lateral guides (8) is conically increased at a slab run-in side of the roughing stand.

* * * * *

UNITED STATES PATENT AND TRADEMARK OFFICE

CERTIFICATE OF CORRECTION

PATENT NO. : 8,429,943 B2
APPLICATION NO. : 11/920212
DATED : April 30, 2013
INVENTOR(S) : Jepsen et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1277 days.

Signed and Sealed this
Eighth Day of September, 2015

Michelle K. Lee

Michelle K. Lee
*Director of the United States Patent and Trademark Office*